US007175023B2

(12) United States Patent
Martin

(10) Patent No.: US 7,175,023 B2
(45) Date of Patent: Feb. 13, 2007

(54) CHISEL SCABBARD WITH REMOVABLE INSERT

(75) Inventor: Graham John Martin, Horbury (GB)

(73) Assignee: Irwin Industrial Tool Company, Huntersville, NC (US)

( * ) Notice: Subject to any disclaimer, the term of this patent is extended or adjusted under 35 U.S.C. 154(b) by 354 days.

(21) Appl. No.: 10/433,357

(22) PCT Filed: Nov. 30, 2001

(86) PCT No.: PCT/GB01/05292

§ 371 (c)(1),
(2), (4) Date: Jan. 20, 2004

(87) PCT Pub. No.: WO02/45922

PCT Pub. Date: Jun. 13, 2002

(65) Prior Publication Data

US 2004/0118722 A1 Jun. 24, 2004

(30) Foreign Application Priority Data

Dec. 4, 2000 (GB) ..... 0029396.9
May 11, 2001 (GB) ..... 0111537.7

(51) Int. Cl.
*A45C 11/26* (2006.01)
*B24B 5/00* (2006.01)
*B26B 3/06* (2006.01)

(52) U.S. Cl. ..... 206/349; 30/138; 30/151; 76/81.3; 451/555

(58) Field of Classification Search ..... 206/349, 206/234; 224/232, 242, 904; 30/138, 151; 76/86, 81.3; 451/555; 15/218.1, 220.4
See application file for complete search history.

(56) References Cited

U.S. PATENT DOCUMENTS

| | | | | | |
|---|---|---|---|---|---|
| 2,696,294 | A | * | 12/1954 | Tarnay | 206/372 |
| 2,767,530 | A | * | 10/1956 | Paldanius | 451/555 |
| 2,779,367 | A | * | 1/1957 | Forbes | 30/167 |
| 2,783,536 | A | * | 3/1957 | McQueary | 30/151 |
| 3,430,760 | A | * | 3/1969 | Ulmer | 206/349 |
| 4,091,691 | A | * | 5/1978 | Bayly | 76/86 |
| 5,138,768 | A | * | 8/1992 | Collins | 30/151 |
| 5,363,957 | A | * | 11/1994 | Reichner | 206/349 |
| 2002/0148746 | A1 | * | 10/2002 | Eriksson et al. | 206/349 |

* cited by examiner

*Primary Examiner*—Bryon P. Gehman
(74) *Attorney, Agent, or Firm*—Dennis J. Williamson; Moore & Van Allen PLLC

(57) ABSTRACT

A chisel scabbard (10) comprises a pouch (12) and a belt clip (22). An insert (14) is received in the mouth (16) of the pouch (12) and is adapted to receive various sizes of chisel. A flat front surface (64) is provided with abrasion material to permit sharpening of the chisel. Clips (50) enable two scabbards to be connected together. A sharpener (90) is provided comprising an abrasion plate (110) mounted in a slider (100). The chisel displaces the plate in the slider on insertion of the chisel in the scabbard. The slider can be actuated to repeat the sharpening stroke. The pouch (12) can comprise two extruded sections (92, 94) and end caps (96, 14').

39 Claims, 10 Drawing Sheets

CHISEL SCABBARD WITH REMOVABLE INSERT

This invention relates to scabbards for chisels. Tradesmen and DIY enthusiasts keep chisels in scabbards when they are in store, but also when in use, both for the purpose of protecting the blade of the chisel and keeping the chisel at hand for when it is needed.

A special scabbard is usually needed for each chisel because it is the blade of the chisel that needs protection (and from which the user also needs protection) and this varies from chisel to chisel. Typical chisel blades generally vary from about 5 mm breadth to 25 mm although both smaller and larger sizes are no doubt feasible. Accordingly, as many scabbard sizes are needed as there are chisel blades. Typical chisels have a length of blade of about 100 mm. Chisels generally have the same size handle, regardless of blade size, and a common transition zone or bolster between blade and handle. A sharp front edge of the blade performs the cutting function of a chisel and is formed at the edge of a bevel face transverse and inclined with respect to the long axis of the chisel.

GB-A-2132930 discloses a knife scabbard having a sharpening device formed between mating halves of a clamshell-type pouch, which device is activated by inserting the knife blade transversely through sharpening windows in the clamshell halves.

GB-A-2132929 discloses a similar arrangement for a scissors sheath.

GB-A-2136341 and GB-A-2083599 show knife scabbards made from plastics mouldings and comprising a pouch to receive the blade of the knife.

In accordance with a first aspect of the present invention there is provided a scabbard comprising a plastics moulding or die-casting forming a pouch deep enough to accommodate the length and width of a plurality of different sizes of typical chisel, an insert fitted in the opening of the pouch and comprising a second plastics moulding or die casting having a mouth leading to a passage through the insert, the mouth and passing being wide enough to receive the blade of a chisel inserted therethrough, the mouth of the insert being a shaped to receive the bolster of the chisel and to locate the chisel in the scabbard.

Preferably the insert is a snap fit in the scabbard pouch.

In one arrangement, a plurality of different inserts is provided, each to receive and locate in the pouch one of said plurality of different sizes of chisel. Thus a single pouch can be made adaptable to many sizes of chisel simply by replacing the insert. Preferably, however, said mouth is wide enough to receive the blade of any of said plurality of chisels.

Most chisels have flat front and back surfaces, although they may be trapezoidal in cross section. The insert preferably has an internal flap in the opening of the insert which is adapted to press against the back surface of a chisel. Preferably, the bore of the insert is substantially flat opposite the flap, and is provided with a series of concentric, increasingly deep, longitudinal grooves, the widths of the grooves corresponding to typical chisel widths and so as to locate transversely a chisel in the bore of the insert.

It is because it is desirable to maintain the sharpness of the blade of a chisel that a scabbard is useful so that the edge of the blade is protected, as well as protecting users from the blade. However, it would also be desirable to be able to increase the sharpness of the blade when it is being used.

Preferably, therefore, the insert has means to sharpen the blade on each insertion of the chisel into the scabbard. Said sharpening means may comprise abrasion material on said flap adapted to abrade the face of the chisel. Said back surface may likewise be provided with abrasion material to remove any burrs on the back face of the chisel. The flap may be biased to towards said back surface and is resiliently deflected from said back surface on insertion of the chisel.

Thus, in a second aspect, the invention provides a chisel scabbard comprising a pouch deep enough to receive the blade of a typical chisel, an insert forming the mouth of the pouch and through which the blade of a chisel is insertable in a direction of the longitudinal axis of the chisel and scabbard, characterised in that the scabbard further comprises a blade sharpener comprising an abrasion plate disposed for movement against resilient bias in a transverse direction with respect to said longitudinal axis and inclined with respect to said longitudinal axis.

Preferably, said plate is supported for movement maintaining the same attitude with respect to said longitudinal axis.

Preferably, said blade sharpener sharpens the blade of a tool on insertion of the tool into said mouth.

Preferably, said blade sharpener has an actuator to permit selective sharpening of the blade of the tool after insertion of the tool into said pouch.

Ideally, said blade sharpener has both features.

A chisel inserted front edge first in the direction of the longitudinal axis of the sharpener encounters the abrasion plate across its path. Further insertion displaces the plate transversely but, since the chisel is moving longitudinally, the plate slides over the bevel face of the chisel and sharpens its edge. That is to say, a sharpening stroke occurs on insertion of the chisel into the scabbard. However, a similar effect occurs in reverse on withdrawal of the chisel from the sharpener. In other words, a return sharpening stroke is effected.

Preferably, the plate is inclined at about 25° with respect to the longitudinal axis of the sharpener, that being the typical bevel angle of the bevel face of most chisels.

Preferably the plate comprises pins disposed transversely of the longitudinal axis and adapted to slide in runners disposed substantially perpendicularly with respect to said longitudinal axis.

Preferably, there are at least two runners disposed parallel with respect to one another and spaced along said longitudinal axis so as to maintain said attitude of the plate with respect to said longitudinal axis.

Said runners may themselves be disposed in a slider mounted in the pouch for movement in the direction of said longitudinal axis, said slider constituting said actuator.

Said slider is preferably resiliently biased towards the mouth of the pouch. Preferably the plate moves in said slider between engaged and disengaged limit positions and, on insertion of said chisel, the respective biases, firstly against movement of the plate in the slider and secondly against movement of the slider in the pouch, are arranged so that the plate moves from the disengaged to the engaged position before the slider moves in the pouch.

The slider is arranged to have sufficient range of movement in the body to permit further movement of the slider in the direction of insertion of the chisel after the chisel itself ceases its movement into the pouch when the chisel bolster has engaged the mouth of the pouch. Clearly, this feature depends, not just on the design of the scabbard of the present invention, but also on the length of the chisel stored and sharpened in it. However, said range of movement is arranged to accommodate a range of typical sizes of chisel commonly available.

As mentioned above insertion of the chisel effects a first sharpening stroke. If the user then slides the slider further in the direction of chisel insertion, a return sharpening stroke is effected by that means, without removing the chisel from the pouch. At the end of that return stroke, the user release the slider and the bias on the slider will return it against the bias on the abrasion plate and effect a sharpening stroke equivalent to the first sharpening stroke. Further back and forth movements of the slider repeat the cycle and this can be continued as long as the user wishes to continue sharpening the chisel. A final return sharpening stroke is effected when the chisel is finally withdrawing from the pouch for use.

With a sufficiently long permissible stroke of the slider in the body, the sharpener can accommodate a number of different lengths of chisels, and indeed shortening lengths of chisels as the sharpening process wears away the end of the chisel.

The slider preferably comprises a carrier portion to mount the plate and disposed internally of the pouch, and an actuator portion disposed externally of the pouch, a connector ligament between the carrier and actuator portions extending through a slot in the pouch. There may be two such slots parallel the longitudinal axis on either side of the pouch, a ligament extending through each slot between the carrier and actuator portions. The actuator portion may be in the form of a part-sleeve conforming to the surface of the pouch.

In a third aspect, the present invention comprises a pouch deep enough to receive the blade of a typical chisel, characterised in that the pouch comprises an extruded section having a cap at one end to close the section, and an insert at the other end forming a mouth to receive chisel blades inserted therethrough in a longitudinal direction of the chisel and scabbard.

Said second and third aspect of the present invention may be combined. Indeed, when said slider of the sharpener is employed, it is arranged to slide on said extruded section of the pouch.

The section may comprise two channel sections facing each other and between them defining said slots to receive said ligaments of the slider.

In a fourth aspect, the present invention provides a scabbard comprising a plastics moulding or die-casting forming a pouch deep enough to accommodate the length and width of a plurality of different sizes of typical chisel, a shim of abrasion material being provided on a front face of the scabbard to permit sharpening of the blade of a chisel.

In this event, the scabbard is preferably also a scabbard as defined above in accordance with the first aspect of the present invention.

In a fifth aspect, the present invention provides a scabbard comprising a plastics moulding or die-casting forming a pouch deep enough to accommodate the length and width of any of a plurality of different sizes of typical chisel, male and female clip-means being provided, one on the front, and the other on the rear, faces of the scabbard so that two such scabbards may be clipped together by insertion of the male clip-means on one scabbard into engagement with the female clip-means of the other.

Preferably, the rear face of the scabbard is substantially flat, so that the scabbard is stable when laid on its rear surface on a horizontal support. In this event a stack of two, three or more scabbards may be stood on a horizontal support, each scabbard clipped to the next by said clip-means. Preferably the front surface of the pouch of the scabbard is substantially flat to receive said rear surface of another scabbard, and is inclined with respect to said rear surface so that a stack of scabbards on a horizontal surface fan upwardly. However, in the case of a scabbard incorporating a slider as defined above, the front and rear surfaces are preferably not inclined with respect to one another to permit the sliding of the slider along the length of the pouch. In any event, such an arrangement provides a useful workshop store for several chisels of different size, presenting each handle, when inserted in the scabbards, in such a way as to permit easy gripping of any one of the chisels.

Preferably, the scabbard is also one of the scabbards defined above in accordance with the first to fourth aspects of the present invention.

The scabbards defined above preferably have a window in the front surface of the pouch so that the blade of a chisel inserted in the pouch is visible, permitting its approximate size to be established without the need for it to be removed first.

Furthermore, the rear surface of the pouch is preferably extended longitudinally beyond its front surface and to the rear thereof is formed a belt clip, said extension being to raise the point of suspension from the belt of a user of the scabbard with a chisel accommodated therein above the centre of gravity of the pair. In this way, the scabbard hangs substantially vertically from the user's belt.

The invention in its different aspects is further described hereinafter, by way of example, with reference to the accompanying drawings, in which:

FIG. 1 is a perspective view of a scabbard in accordance with some aspects of the present invention (shown with a chisel inserted);

FIGS. 2*a* to *c* are a side view (shown with a chisel inserted), a front view, and a rear view of the scabbard of FIG. 1;

FIGS. 3*a* and *b* are a bottom view and a top plan view of the scabbard of FIG. 1;

FIGS. 4*a* to *e* are a bottom view, a top plan view, a front view, a side view and a side section, of an insert used in the scabbard of the previous drawings;

FIGS. 5*a* and *b* are a side and face view of a scabbard in accordance with at least the second aspect of the present invention;

FIGS. 6*a* and *b* are side views similar to FIG. 5 with some modifications and showing different positions of the slider and an inserted chisel, FIG. 6*c* being a view in the direction of arrow C in FIG. 6*b*.

A chisel scabbard 10 comprises a plastics moulding forming a pouch 12 and a separate moulded plastics insert 14 fitted in the open mouth 16 of the pouch 12. Conceivably, the scabbard could instead comprise a die-casting of an appropriate alloy.

Figure 1:
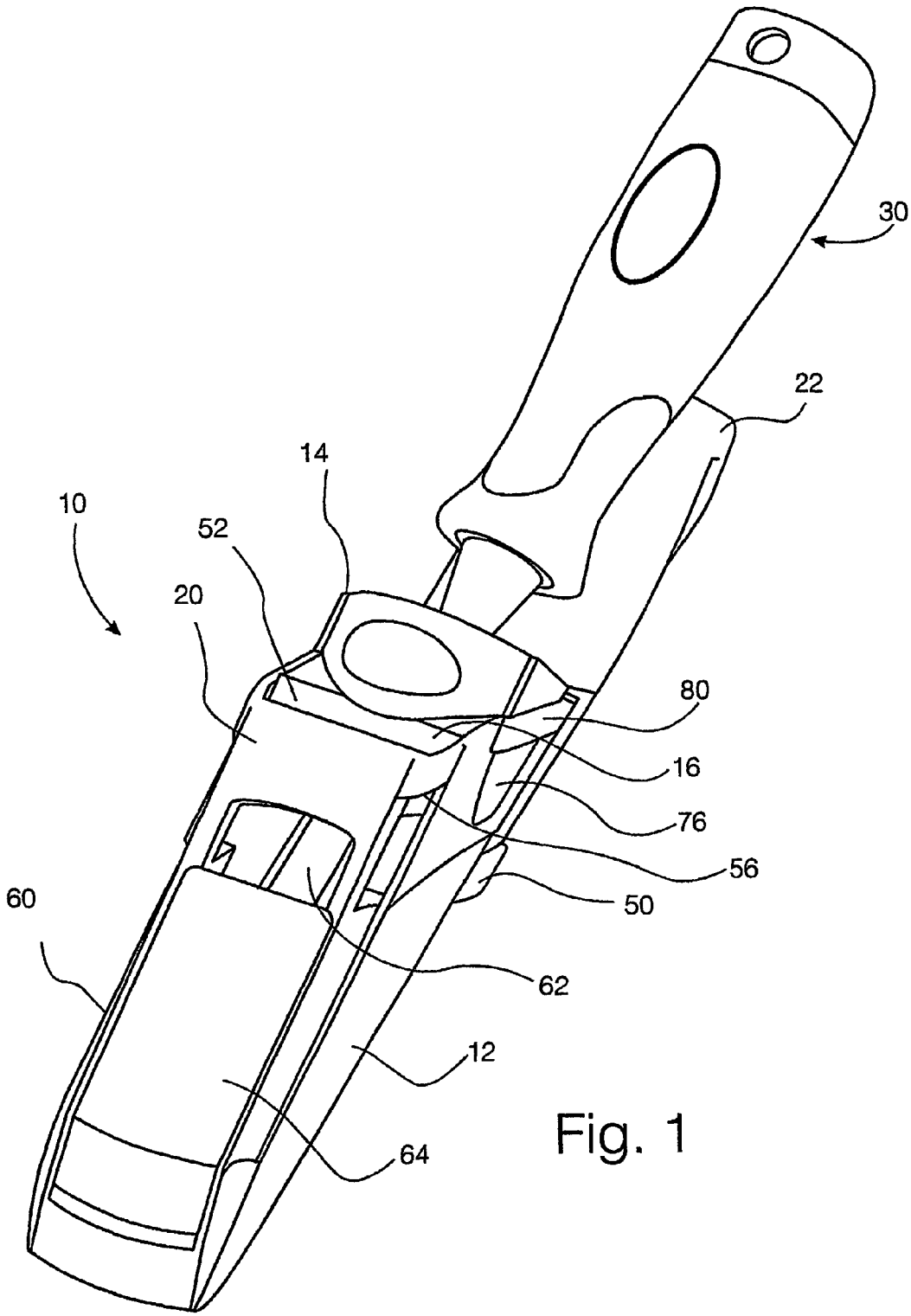
Figure 2A:
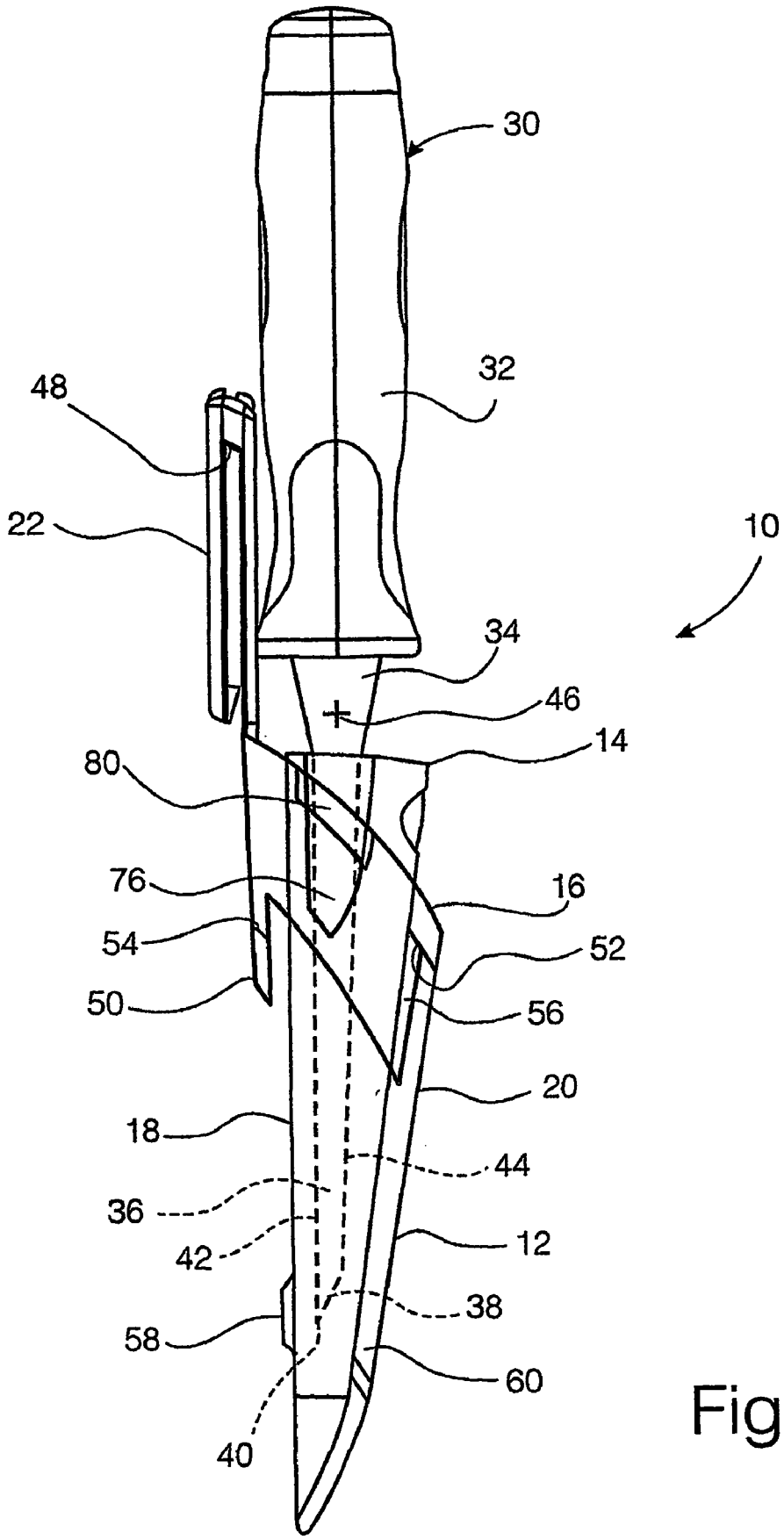
Figure 2B:
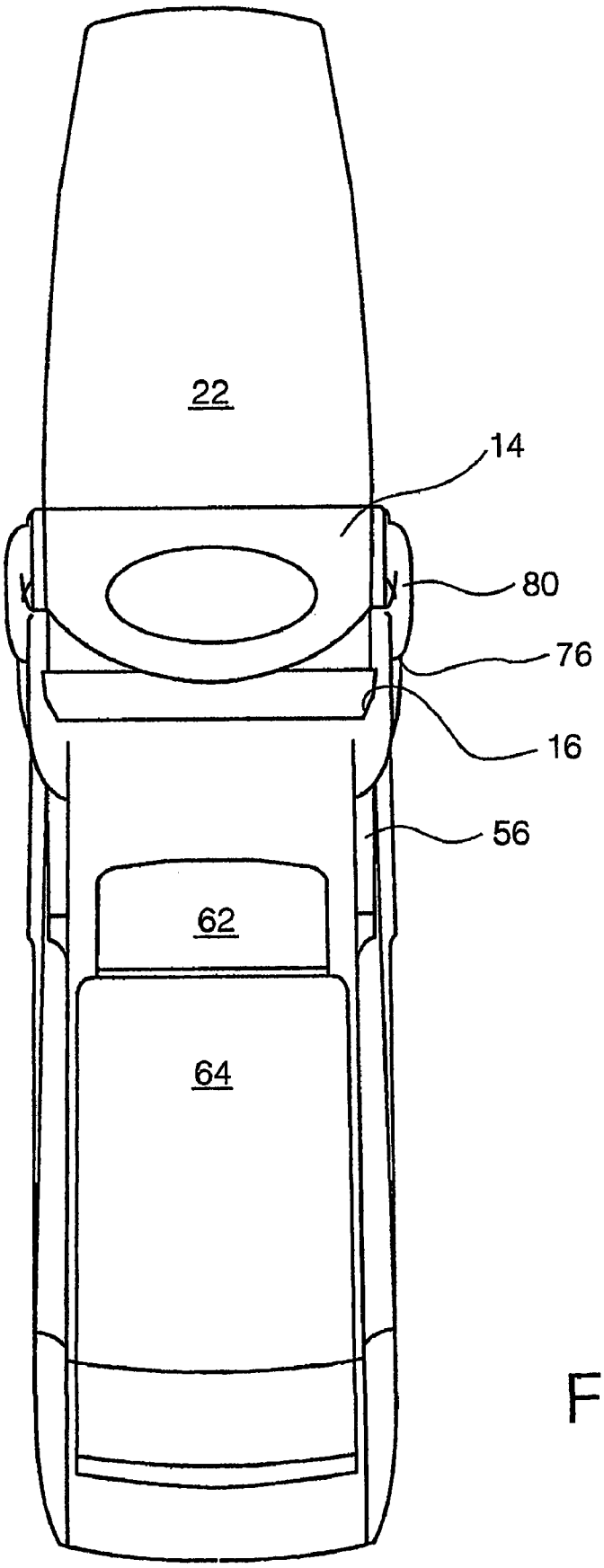
Figure 2C:
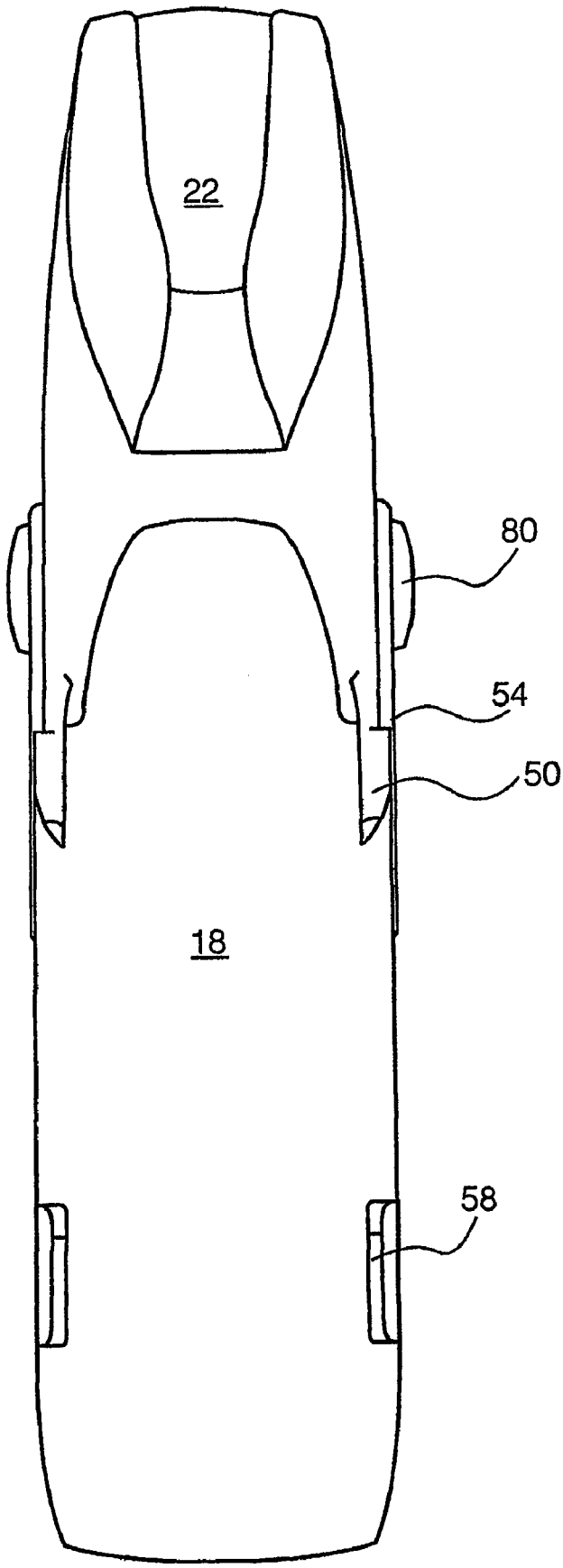
Figure 3A:
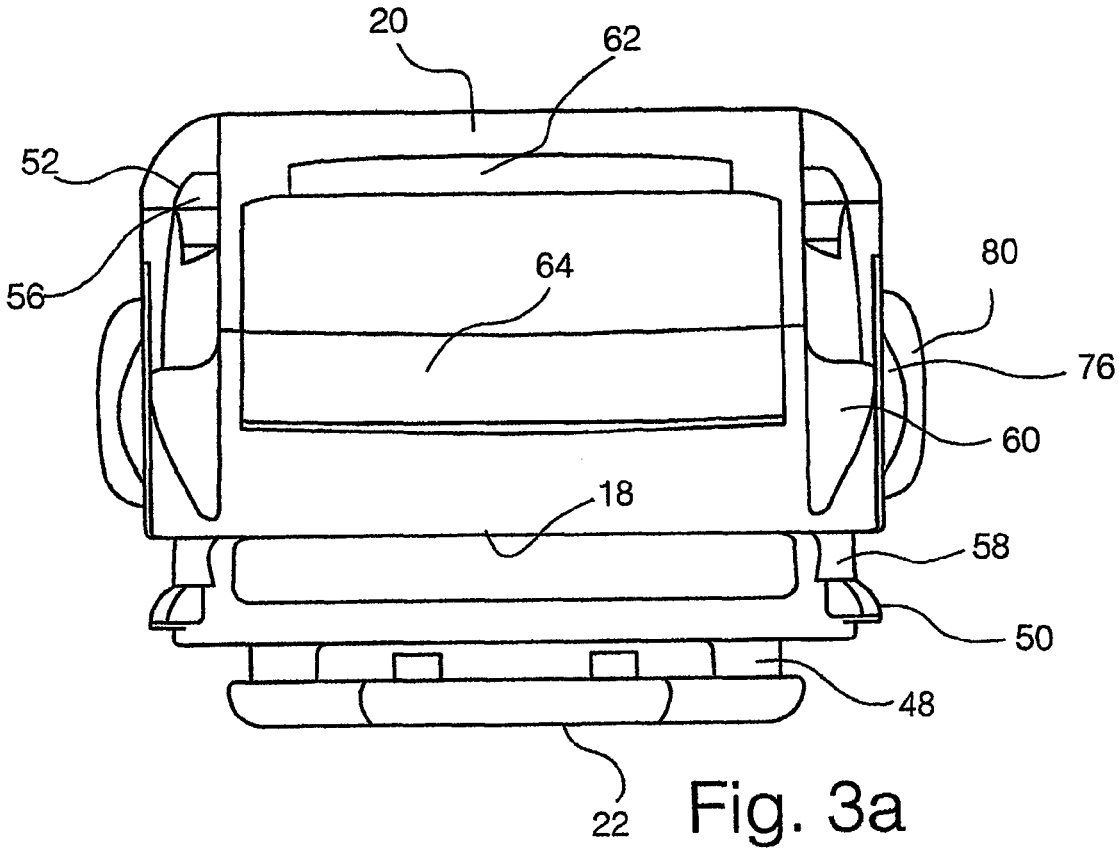
Figure 3B:
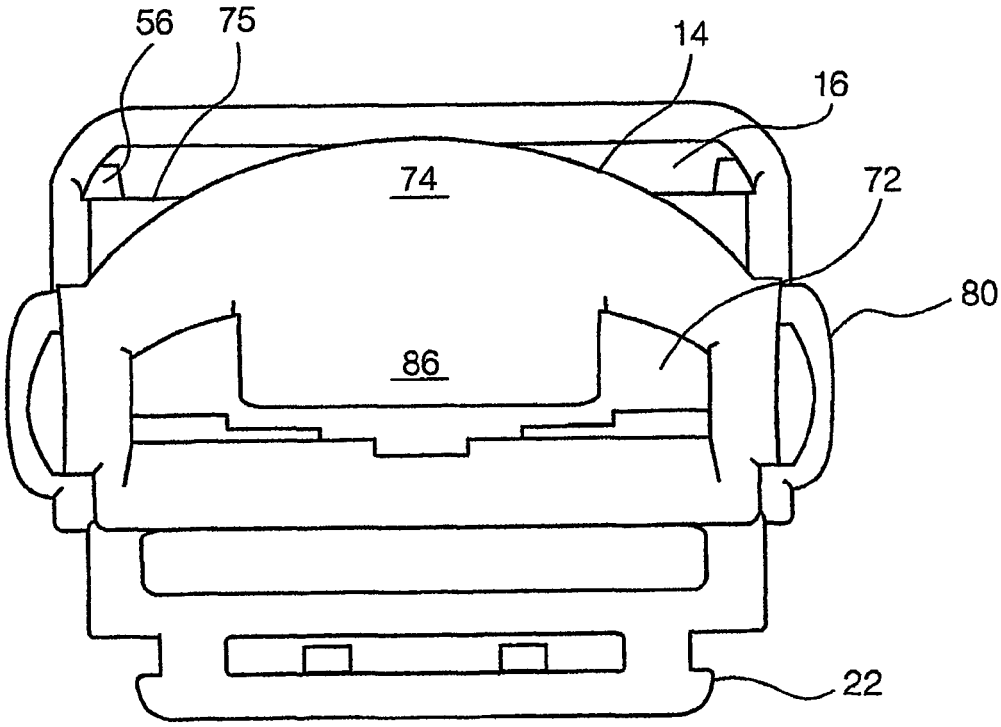

The pouch 12 has a substantially flat rear surface 18 and a substantially flat front surface 20 which is inclined with respect to the rear surface 18. Extending above the pouch 12 as an extension of the rear surface 18 is a belt clip 22. In FIG. 2*a*, a chisel 30 is shown received in the scabbard 10, the chisel having a handle 32, a bolster 34, and a blade 36. The blade 36 has a front bevel face 38 presenting an edge 40 where the front face meets a rear face 42. A top surface 44 of the blade extends from the rear edge of front bevel face 38.

The centre of gravity of a chisel is normally in the region of the bolster 34, as shown at 46 in FIG. 2*a*. This is some way below the suspension point 48 of the belt clip 22 so that, when the belt clip is clipped over a belt of a user, the scabbard hangs substantially vertically.

However, when placed on a work surface, the rear surface 18 being substantially flat, the scabbard lies on such a surface quite stably with the handle 30 of a chisel being presented for easy access by a user.

On the rear surface 18 of the pouch 20 is provided male clip elements 50, one on either side of the rear surface 18 of the pouch. Likewise, the mouth 16 of the pouch present female clip-means 52. When two scabbards as shown in the drawings are presented to one another, the rear clip-means 50 can be inserted into the front clip-means 52 of the other scabbard until barbs 54 on the male clip-means snap into engagement with side windows 56 of the female clip-means 52. Furthermore, in order to maintain the stability of the connection between the two scabbards, the rear surface 18 of the pouch 12 near its bottom end is provided with two lips 58 adapted to fit snugly around front grooves 60 on the front face 20 of the scabbard 12.

Because of the inclination of the front face 20 with respect to the rear face 18, when several scabbards are connected together in series and the lowermost one placed on a table, a fan of chisel handles 30 is presented to the user so that the collection of scabbards constitutes a convenient storage device for chisels 30.

The front face 20 of the pouch 12 is provided with a window 62 through which the blade of a chisel inserted into the scabbard is visible. This enables the size of the chisel received in the scabbard to be seen and estimated. Furthermore, a patch or shim of abrasive impregnated resin 64 is applied to the remaining front face 20 of the scabbard so that a user can always give his or her chisel a final sharpening before each use. Because the scabbard 12 is constructed from moulded plastics material (for example polypropylene) it has a relatively rigid construction so that a shim of abrasive impregnated resin (for example a block about 1 mm thick), is not only flat, but is adequately supported across its entire area so that it is unlikely to crack in use.

The insert 14 is a separate moulding from the pouch 12 and belt clip 22 so that the pouch 12 can be moulded in a relatively straightforward mould. Turning to FIG. 4, the insert 14 is shown therein. This comprises a plastics moulding or die-casting essentially in the form of a ring 70 having a through bore or passage 72. The ring 70 is complete at the top end 74 of the insert, but from the ring comprises a number of downwardly depending flaps. A top flap 75 forms, with the mouth 16 of the pouch 12, the pocket for the female clip-means 52. Side flaps 76 have catch elements 78 which engage with bars 80 on the side of the pouch 12 to retain the insert 14 in the mouth 16 of the pouch 12. Bottom flap 82 is a support surface for the bottom face 42 of the blade 36 of a chisel 30 and it has, on the bore-72-side thereof, a series of concentric grooves 84*a, b* and *c* which each has a width corresponding to a different typical size of chisel blade. For example chisels of width 5 mm, 10 mm and 25 mm might fit snugly in the grooves 84*a, b* and *c* respectively.

Figure 4A:
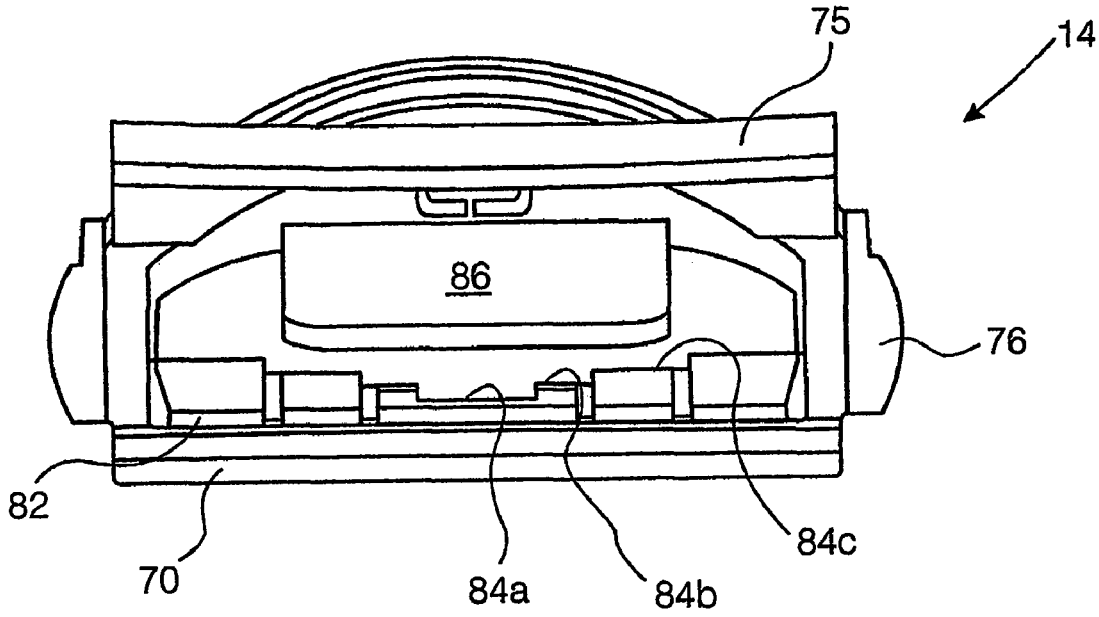
Figure 4B:
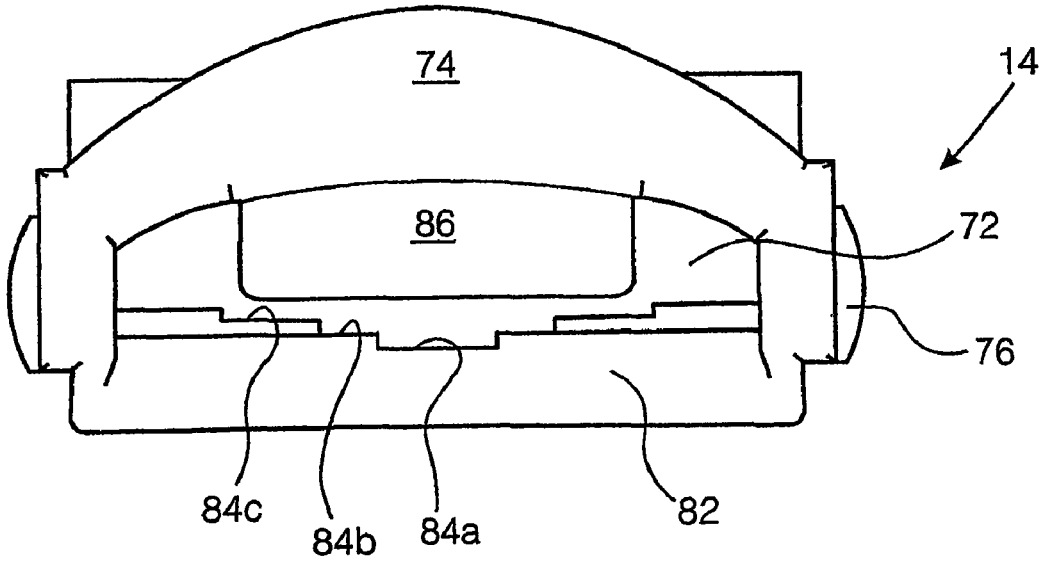
Figure 4C:
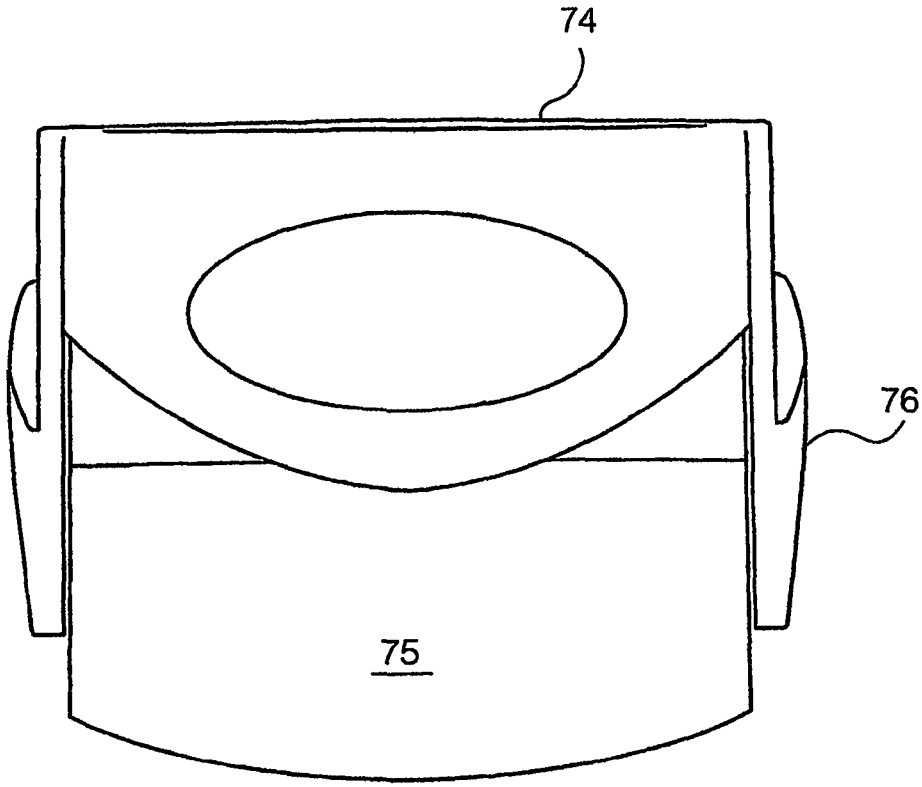
Figure 4D:
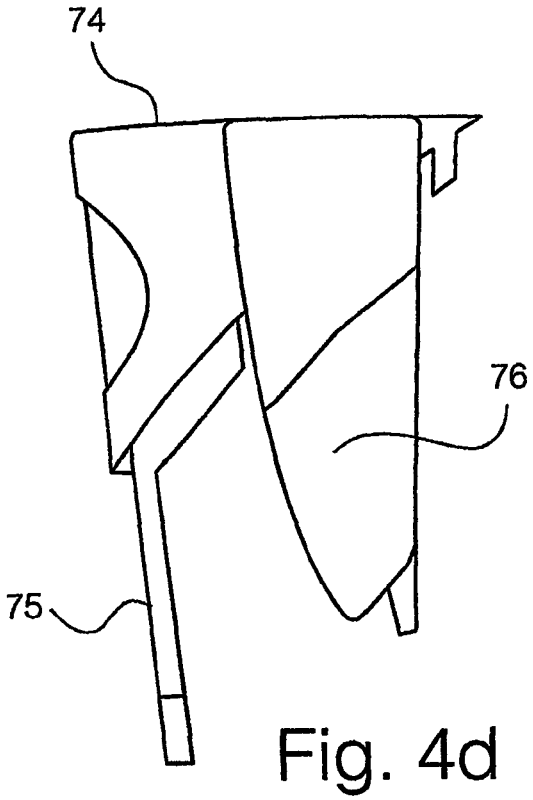
Figure 4E:
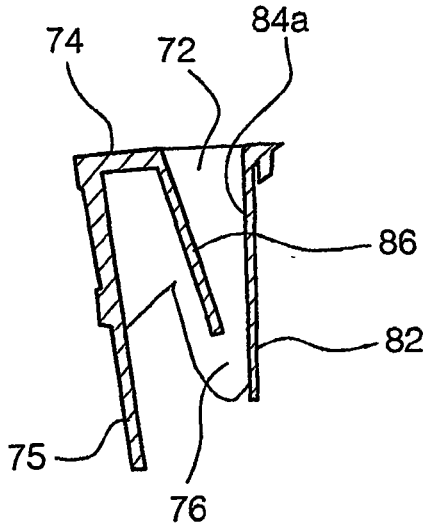

Opposite the flap 82 is a central tongue-flap 86 which depends towards the flap 82 from its root in the face of ring 70. As can be seen in FIG. 4*e*, when a chisel is inserted into the bore 72 from the end 74 of the insert 14, the bottom face 42 of the chisel slides along the base of the appropriate grove 84*a, b* or *c*, with the top surface 44 of the chisel being pressed downwardly by the flap 86, which is resiliently deformed by the insertion of the chisel.

Eventually, the bolster 34 becomes wedged in the bore opening 72 so that the chisel is firmly located in the insert 14 and hence in the scabbard 10.

The insert illustrated herein is suitable for reception of a number of different sizes of chisel as are typically employed. However, it is equally possible to have an insert which is dedicated to a particular size of chisel.

Although not illustrated in the embodiments shown in FIGS. 1 to 4, it is feasible to attach an abrasion pad on the end of the tongue 86 and to provide spring means between the tongue 86 and the tab 75 so that the face 38 of a chisel when it is inserted into the scabbard is sharpened on each occasion that it is inserted. It is also possible to line the floor of the tab 82 with abrasion material so that burrs which inevitably form on the under surface 42 of the edge 40 of the chisel when the face 38 is abraded, are also removed when the chisel is inserted in the scabbard 10.

Figure 5A:
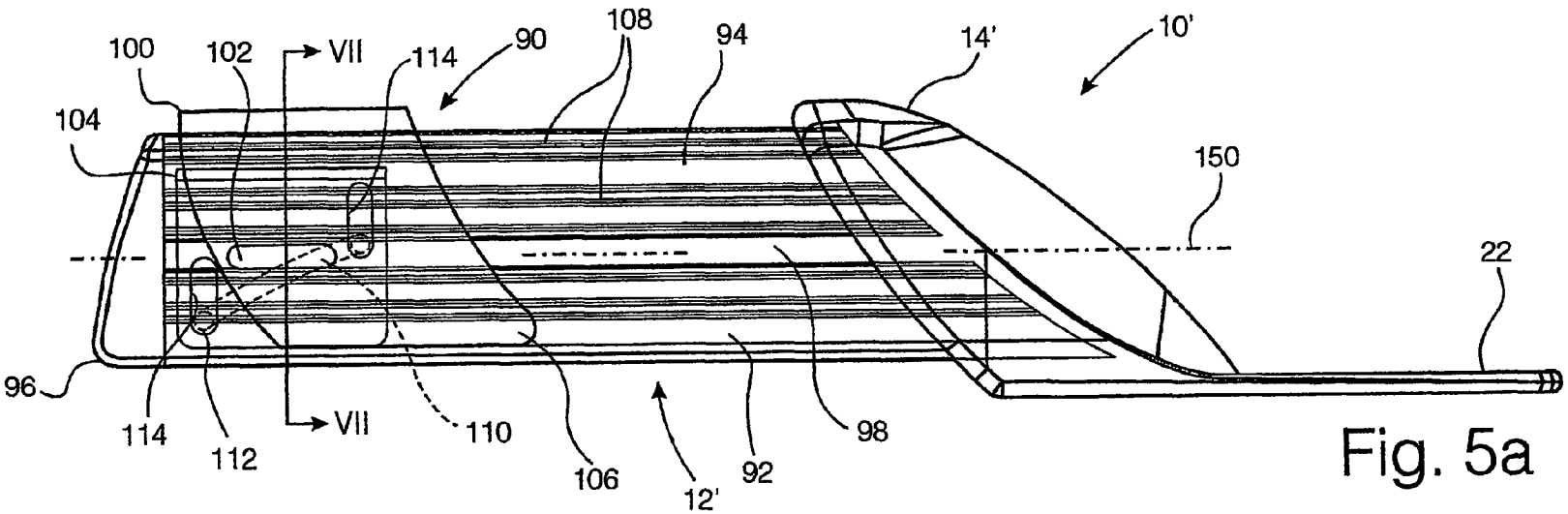
Figure 5B:
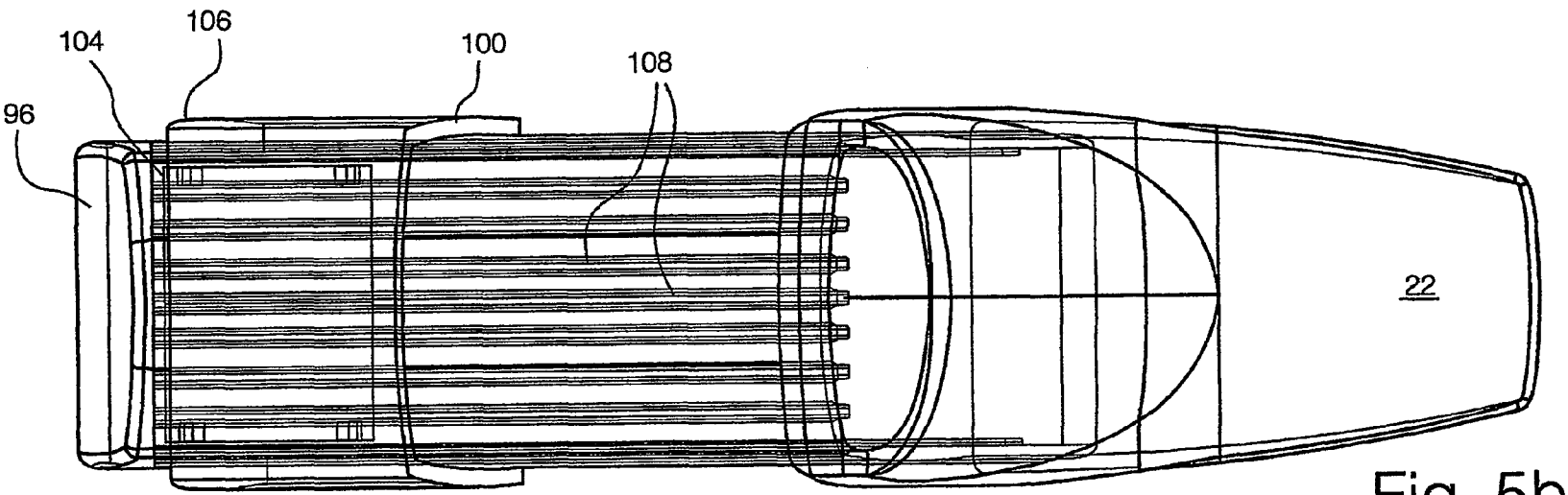
Figure 6A:
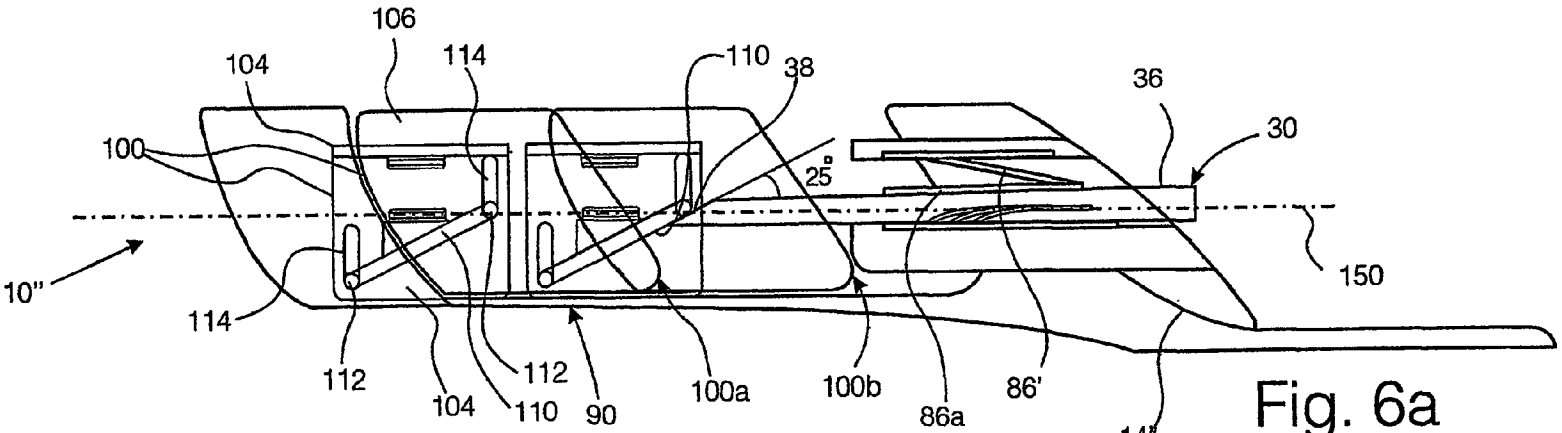
Figure 6B:
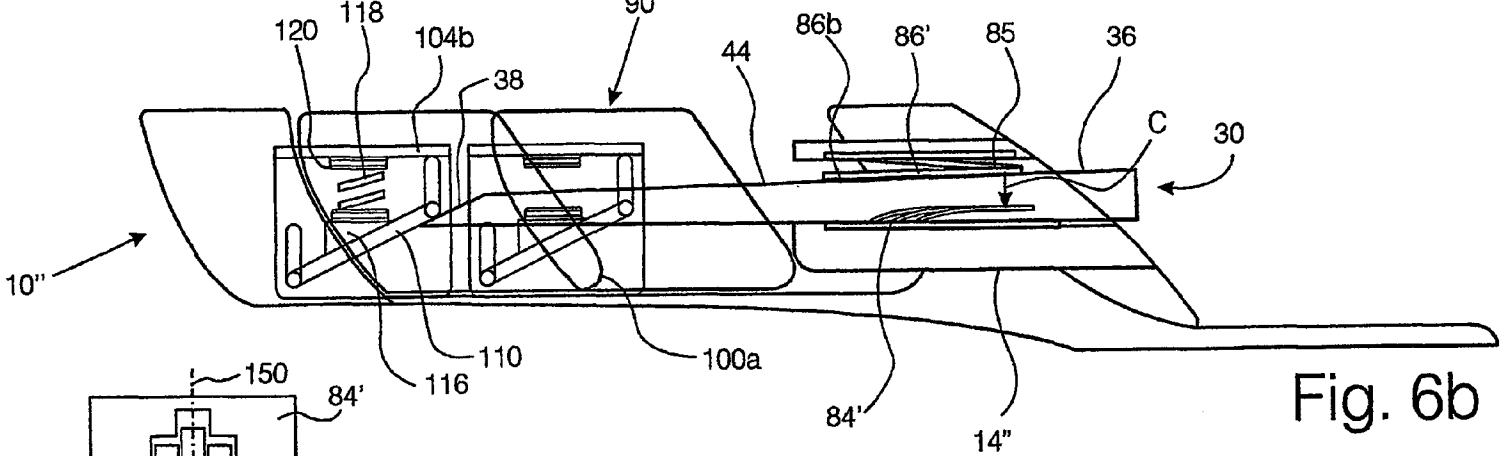
Figure 6C:
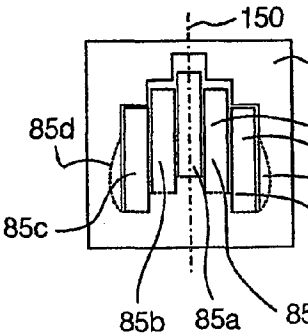
Figure 7:
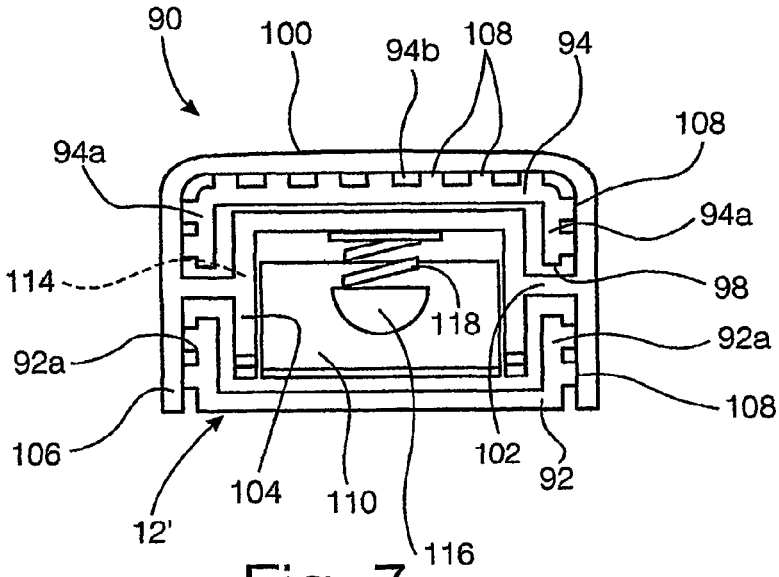
FIG. 7 is a cross section on the line VII—VII in FIG. 5*a*.

Turning to FIGS. 5 to 7, a different embodiment is illustrated in which a sharpener 90 is provided in scabbard 10'. The scabbard 10' is like the scabbard of the embodiments described with reference to FIGS. 1 to 4. Where different but functionally equivalent components are employed, the same reference numerals are used, except that they are given an apostrophe or quotation mark.

The scabbard 10' is not a moulding but comprises two channel section extrusions 92, 94 connected at their ends by an end cap 96 and an insert end 14'. The insert 14' differs from the insert 14 of the previous embodiments by incorporating the extension 22 and belt clip thereof (the belt clip is only shown in FIG. 8). The channel sections 92, 94 have their side walls 92*a*, 94*a* facing one another and separated so as to define a slot 98 between them. The slot captivates a ligament 102 of a slider 100 forming the sharpener 90. The ligament 102 extends between an inner carrier portion 104 of the slider 100 and an outer actuator portion 106. The actuator 106 is grasped, in use, by the user to slide the slider 100 back and forth along the sections 92, 94 between the end caps 96, 14'. To reduce friction between the slider 100 and the channel sections 92, 94, the sides 92*a*, 94*a* of the sections and top 94*b* of the top channel section 94, are provided with ribs 108 against which the slider runs.

The internal carrier 104 therefore runs within the pouch 12' largely free of contact with the internal surfaces of the channels 92, 94.

The carrier portion 104 carries an inclined abrasion plate 110, best seen in FIG. 6. The abrasion plate 110 has four pins 112, one at each corner of the plate. The pins 112 are retained in slots 114 in the carrier portion 104 of the slider 100. The slots 114 are oriented perpendicularly with respect to the longitudinal axis 150 of the scabbard 10' which axis is also the direction of insertion of a chisel 30. Moreover, the separation of the slots 114 in the longitudinal direction is less than the separation between pins 112 on the same side of the abrasion plate 110. This has the effect of forcing the abrasion plate 110 to adopt and maintain an inclined attitude with respect to the longitudinal axis 150. Indeed, the dimensions are chosen so that the angle of inclination is about 25°, being the normal angle of inclination of chisel bevel faces 38.

A spring cup 116 is formed on the reverse side of the abrasion plate 110, and this is adapted to house a spring 118 whose other end is received in a cup 120 in the roof 104*b* of the carrier portion 104 of the slider 100.

A slider spring (not shown) acts between end cap 96 and the slider 100 in the longitudinal direction 150. In FIG. 6, the slider is shown in two positions 100*a*, 100*b*. The slider spring urges the slider towards the position 100*b*. The abrasion plate spring 118 urges the abrasion plate 110 downwardly (with respect to the orientation of the drawings). With reference to FIG. 6*a*, a chisel 30 is inserted through the mouth of insert 14" until the blade 36, or rather its bevel face 38 contacts the under surface of abrasion plate 110, the slider being in the position 100*b* with the abrasion plate 110 being urged to its bottom most positions with the pins 112 engaging the base of the slots 114. The strength of the slider spring verses the abrasion plate spring 118 is so arranged that, as the blade 36 of the chisel 30 is inserted further into the scabbard 10" along the longitudinal axis 150, the plate 110 rises first in the slots 114, compressing the plate spring 118, before the slider 100 begins to move. However, when the plate 110 has moved to an upper limit position, in which the pins 112 contact the top ends of the slots 114, further insertion of the chisel 30 into the scabbard now begins to move the slider 100 leftwardly in the drawings and compressing the slider spring.

The scabbard is dimensioned so that, for typical chisels 30, the chisel is fully located in the scabbard (that is to say, its bolster (not shown) abuts the mouth of the insert 14" and halts further insertion) when the slider 100 has moved to a position intermediate the positions 100*a*, 100*b*.

When the chisel moves the plate 110 upwardly in the drawings on its insertion into the scabbard, the bevel face 38 must slide down the abrasion plate 110. The abrasion plate 110 is constructed from a resinous material impregnated with hard, abrasive particles such as silicon carbide or diamond stone etc. Thus, in sliding down the plate 110 a sharpening action is effected on the bevel face 38.

However, should the user of the chisel and scabbard wish to effect further sharpening strokes on the bevel face 38, it is not necessary to withdraw and reinsert the chisel 30. Instead, the range of leftward movement in the drawings of the slider 100 with respect to the insert 14" is arranged sufficient so that, even though the chisel is fully inserted, further leftward movement of the slider 100 is possible to its limit position 100*a*. In FIG. 6*b*, the blade 36 is fully inserted and the slider, in position 100*a*, has been pulled there by the user against the pressure of the slider spring (not shown) and such that the abrasion plate 110 has slid down the bevel face 38 under the action of the spring 118 and so as to effect a sharpening return stroke. Should the user now release the slider 100 from the position 100*a*, the slider spring will push the slider rightwardly in the drawing effecting a further sharpening stroke on the bevel face 38 as the plate 110 moves back up the slots 114, against the bias of plate spring 118, and until the pins 112 engage the upper ends of the slot 114, where upon further rightward movement of the slider 100 is prevented.

The insert 14" may be similar to the insert described above with reference to FIGS. 1 to 4, except that, here, tongue 86' is provided with a fold 86*a* adapted to bear against rear surface 44 of the chisel blade 26. In this arrangement, the tongue 86' is a separate metal component press fitted in the insert 14". Likewise, the grooved floor has been replaced by a spring steel plate 84' having a number of longitudinally arranged upstanding fingers 85. The floor 84', like the tongue 86', may be a separate component to the insert 14" and may comprise a sheet of spring steel from which the fingers 85 have been punched and deformed. Indeed, the components 84', 86' may be integral and formed from a single sheet of spring steel. The fingers 85 are each about 5 mm wide so that a particularly narrow chisel of only 5 mm width, when inserted into the mouth of the insert 14" will ride over central tongue 85*a* but not depress tongues 85*b* on either side of it. Instead, those tongues will serve to guide the chisel and retain it centrally on tongue 85*a* and also parallel the longitudinal axis 150. If the chisel is 10 mm wide, then it can be inserted over fingers 85*a* and one of fingers 85*b*, the chisel then being guided by the other finger 85*b* and an outer finger 85*c*. The same situation can be seen to pertain with chisels of 15 mm, 20 mm and 25 mm widths. For the latter two, the external rim of the floor 84 may be deformed upwardly at 85*d* in order to retain chisels of sufficient width to compress either or both of the fingers 85*c*.

The embodiments in FIGS. 5 and 6 differ from one another only in their method of construction. In FIG. 5, as explained above, the scabbard comprises two extruded channel sections 92, 94 facing one another and captured by end cap 96 and insert 14'. However, it is also feasible to construct the scabbard from mouldings, as long as the parts over which the slider 100 slides are made from mouldings which do not require a draw in the longitudinal direction. This can be achieved by moulds opening transversely of the longitudinal axis 150, for example.

Figure 8:
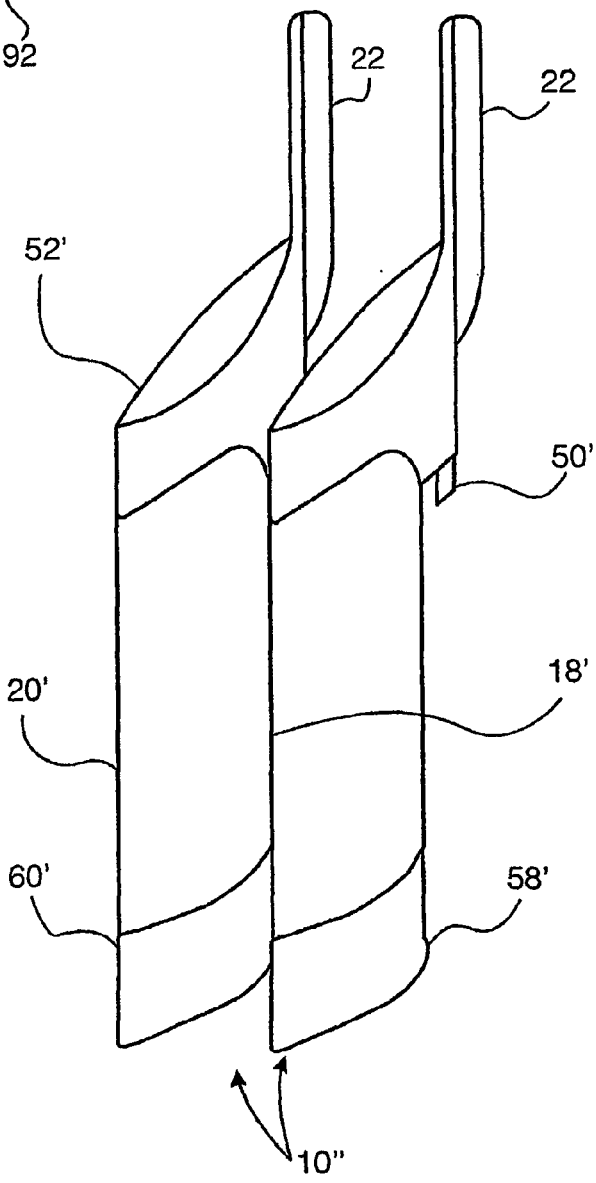
FIG. 8 is a side view of two stacked chisels of the FIG. 6 embodiment.

Finally, with reference to FIG. 8 of the drawings, two scabbards 10" are shown stacked together in which male clips 50' engaged in female slots 52', tabs 58' engaging indents 60'. Different from the embodiments of FIGS. 1 to 4, the faces 18' 20' of the scabbard 10" are not inclined with respect to one another. Therefore, when stacked together with each scabbard including a chisel therein, the chisel handles will not fan out as in the earlier embodiment discussed herein. Nevertheless, they are conveniently presented to a user for selection.

The invention claimed is:

1. A scabbard for receiving one of a plurality of different sizes of chisels, the chisels having bolsters comprising:

a plastics moulding or die-casting forming a pouch deep enough to accommodate the length and width of the plurality of different sizes of chisels, an insert removably fitted in the opening of the pouch and comprising a second plastics moulding or die casting having a mouth leading to a passage through the insert, the mouth and passage being wide enough to receive the blade of at least one of the plurality of different sizes of chisels inserted therethrough, the mouth of the insert being a shaped to receive the bolster of the at least one of the plurality of different sizes of chisels and to locate the at least one of the plurality of different sizes of chisels in the scabbard.

2. A scabbard according to claim 1 wherein the insert is a snap fit in the scabbard pouch.

3. A scabbard according to claim 1, wherein a plurality of different inserts is provided, each to receive and locate in the pouch different ones of the plurality of different sizes of chisels.

4. A scabbard according to claim 1, wherein said mouth is wide enough to receive the blade of of at least two of the plurality of different sizes of chisels.

5. A scabbard according to claim 4, wherein the insert has an internal flap which is adapted to press against the plurality of different sizes of chisels.

6. A scabbard according to claim 5, wherein said flap is biased such that said flap is resiliently deflected on insertion of the plurality of different sizes of chisels.

7. A scabbard according to claim 5, wherein the passage of the insert is substantially flat opposite the flap, and is provided with a series of concentric, increasingly deep, longitudinal grooves, the widths of the grooves corresponding to typical chisel widths so as to locate transversely at least two of the plurality of different sizes of chisels in the passage of the insert.

8. A scabbard according to claim 7, wherein said passage is provided with abrasion material to remove any burrs on the at least two of the plurality of different sizes of chisels.

9. A scabbard according to claim 1, wherein the insert has means to sharpen the blade on each insertion of a chisel into the scabbard.

10. A scabbard according to claim 9 wherein said mouth is wide enough to receive the blade of the plurality of different sizes of chisels, wherein the insert has an internal flap in the opening of the insert which is adapted to press against the plurality of different sizes of chisels, and wherein said means to sharpen comprises abrasion material on said flap adapted to abrade the blade of the plurality of different sizes of chisels.

11. A scabbard according to claim 10, wherein said flap is biased such that said flap is resiliently deflected on insertion of the plurality of different sizes of chisels.

12. A scabbard according to claim 1, further comprising a window in the front surface of the pouch so that the blade of a chisel inserted in the pouch is visible and its approximate size can be established without the need for it to be removed.

13. A scabbard according to claim 1, wherein the pouch includes a rear surface and a front surface, the rear surface of the pouch extends longitudinally beyond the front surface of the pouch, a belt clip formed on said rear surface, said rear surface of the pouch extending longitudinally beyond the front surface of the pouch such that a point of suspension from the belt of a user of the scabbard with a chisel accommodated therein is located above the centre of gravity of the chisel and scabbard.

14. A scabbard comprising a plastics moulding or die-casting forming a pouch deep enough to accommodate the length and width of a plurality of different sizes of typical chisel, an insert removably fitted in the opening of the pouch, a shim of abrasion material being provided on a face of the insert to permit sharpening of the blade of a chisel.

15. A scabbard according to claim 14, wherein the insert comprises a second plastics moulding or die casting having a mouth leading to a passage through the insert, the mouth and passage being wide enough to receive the blade of a chisel inserted therethrough, the mouth of the insert being a shaped to receive the bolster of the chisel and to locate the chisel in the scabbard.

16. A scabbard for a plurality of different sizes of chisels having bolsters comprising a plastics moulding or die-casting forming a pouch deep enough to accommodate the length and width of a plurality of different sizes of, chisels and having a first face and a second face, a first means for clipping the scabbard to another scabbard and a second means for clipping the scabbard to another scabbard so that the scabbard may be clipped to another scabbard by connecting the first means on the scabbard with a second means of another scabbard.

17. A scabbard according to claim 16, wherein the first face of the scabbard is substantially flat, so that the scabbard is stable when laid on its first face on a horizontal support.

18. A scabbard according to claim 17, wherein the second face of the scabbard is substantially flat to receive said first face of another scabbard, and is inclined with respect to said first face so that a stack of scabbards on a horizontal surface fan upwardly.

19. A scabbard according to claim 16, further comprising an insert fitted in the pouch and comprising a second plastics moulding or die casting having a mouth leading to a passage through the insert, the mouth and passage being wide enough to receive the blade of a chisel inserted therethrough, the mouth of the insert being shaped to receive the bolster of the chisel and to locate the chisel in the scabbard.

20. A scabbard according to claim 16, further comprising an insert fitted in the pouch and comprising a second plastics moulding or die casting having a mouth leading to a passage through the insert, the mouth and passage being wide enough to receive the blade of a chisel inserted therethrough, the mouth of the insert being a shaped to receive the bolster of the chisel and to locate the chisel in the scabbard, a shim of abrasion material being provided on a front face of the scabbard to permit sharpening of the blade of a chisel.

21. A scabbard according to claim 16, further comprising a shim of abrasion material on a front face of the scabbard to permit sharpening of the blade of a chisel.

22. A scabbard for receiving one of a plurality of different sizes of chisels, the chisels having bolsters comprising:

a plastics moulding or die-casting forming a pouch deep enough to accommodate the length and width of the a plurality of different sizes of chisels, an insert removably fitted in the opening of the pouch and comprising a second plastics moulding or die casting having a mouth leading to a passage through the insert, the mouth and passage being wide enough to receive the blade of at least one of the plurality of different sizes of chisels inserted therethrough, the mouth of the insert being a shaped to receive the bolster of the at least one of the plurality of different sizes of chisels and to locate the at least one of the plurality of different sizes of chisels in the scabbard;

wherein the blade of a chisel is insertable through the mouth of the insert in a direction along a longitudinal axis of the scabbard and along a longitudinal axis of the chisel, wherein the scabbard further comprises a blade sharpener comprising an abrasion plate disposed for movement against resilient bias in a transverse direction with respect to said longitudinal axis of the scabbard and inclined with respect to said longitudinal axis of the scabbard.

23. A scabbard according to claim 22, wherein said abrasion plate is supported for movement between a first position and a second position such that said abrasion plate maintains a substantially constant incline with respect to said longitudinal axis in both the first position and second position.

24. A scabbard according to claim 22, wherein said blade sharpener sharpens the blade of a chisel on insertion of the chisel into said mouth.

25. A scabbard according to claim 22, wherein said blade sharpener has an actuator to permit selective sharpening of the blade of the chisel after insertion of the chisel into said mouth.

26. A scabbard according to claim 22, wherein the plate is inclined at about 25° with respect to the longitudinal axis of the scabbard.

27. A scabbard according to claim 22, wherein the plate comprises pins disposed transversely of the longitudinal axis of the scabbard and adapted to slide in runners disposed substantially perpendicularly with respect to said longitudinal axis of the scabbard.

28. A scabbard according to claim 27, wherein said plate is supported for movement between a first position and a second position such that said abrasion plate maintains a substantially constant incline with respect to said longitudinal axis in both the first position and second position, wherein there are at least two runners disposed parallel with respect to one another and spaced along said longitudinal axis of the scabbard so as to maintain said incline of the plate with respect to said longitudinal axis.

29. A scabbard according to claim 27, wherein said runners are slots in a slider mounted in the pouch for movement in the direction of said longitudinal axis, said slider comprising an actuator.

30. A scabbard according to claim 29, including means for resiliently biasing said slider towards the mouth of the pouch.

31. A scabbard according to claim 30, wherein the plate moves in said slider between engaged and disengaged limit positions such that the plate moves from the disengaged limit position to the engaged limit position before the slider moves in the pouch.

32. A scabbard according to claim 29, wherein the slider has a range of movement in the pouch to permit further movement of the slider in the direction of insertion of the chisel after the chisel bolster has engaged the mouth of the pouch, the chisel being at least of a length sufficient to move the abrasion plate in the slider to effect a sharpening stroke.

33. A scabbard according to claim 29, wherein the slider comprises a carrier portion to mount the plate and disposed internally of the pouch, and an actuator portion disposed externally of the pouch, a connector ligament between the carrier and actuator portions extending through a slot in the pouch.

34. A scabbard according to claim 33, wherein there are two such slots parallel the longitudinal axis on either side of the pouch and two connector ligaments, one of said two connector ligaments extending through each slot between the carrier and actuator portions.

35. A scabbard according to claim 33, wherein the actuator portion has the form of a part-sleeve conforming to the pouch.

36. A scabbard according to claim 33, wherein the pouch comprises an extruded section having a cap at one end to close the section and an insert at the other end forming a mouth to receive chisel blades inserted therethrough in a longitudinal direction of the chisel and scabbard and wherein said slider is arranged to slide on said extruded section of the pouch.

37. A chisel scabbard comprising a pouch deep enough to receive the blade of a typical chisel, wherein the pouch comprises an extruded section having a cap at one end to close the section and a removable insert at the other end removably fitted in an opening of the pouch , the removable insert forming a mouth to receive chisel blades inserted therethrough in a longitudinal direction of the chisel and scabbard.

38. A scabbard according to claim 37, wherein the pouch comprises two extruded channel sections disposed edge to edge so as to define facing edges and slots between said facing edges.

39. A scabbard comprising one of a plastics moulding or die-casting forming a pouch having an opening, the pouch being deep enough to accommodate the length and width of a plurality of different sizes of typical chisel, an insert removably fitted in the opening of the pouch, a shim of abrasion material being supported in the pouch to permit sharpening of the blade of a chisel.

* * * * *